US011134792B2

(12) United States Patent
Case et al.

(10) Patent No.: US 11,134,792 B2
(45) Date of Patent: Oct. 5, 2021

(54) SYSTEM AND METHOD FOR HIDING MOLDING FLASH

(71) Applicant: Illinois Tool Works Inc., Glenview, IL (US)

(72) Inventors: Michael Case, Rockford, IL (US); Randy James Sayers, Howard City, MI (US); David B. Nordquist, Rockford, MI (US); Kelly Washburn, Middleville, MI (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/818,513

(22) Filed: Mar. 13, 2020

(65) Prior Publication Data

US 2020/0323357 A1 Oct. 15, 2020

Related U.S. Application Data

(60) Provisional application No. 62/831,527, filed on Apr. 9, 2019.

(51) Int. Cl.

| | |
|---|---|
| ***A47C 7/02*** | (2006.01) |
| ***A47C 31/02*** | (2006.01) |
| ***A47C 7/28*** | (2006.01) |

(52) U.S. Cl.

CPC ..... *A47C 31/02* (2013.01); *A47C 7/282* (2013.01)

(58) Field of Classification Search

CPC ..... A47C 31/02; A47C 7/282

USPC ..... 297/218.1, 218.3, 218.4, 218.5, 452.12, 297/452.13, 452.56, 452.63, 452.64

See application file for complete search history.

(56) References Cited

U.S. PATENT DOCUMENTS

| | | | | | |
|---|---|---|---|---|---|
| 94,553 | A * | 9/1869 | Binhgam | A47C 31/02 | 5/403 |
| 662,647 | A * | 11/1900 | Howe | E06B 7/32 | 160/179 |
| 1,955,187 | A * | 4/1934 | Howard | A47C 31/02 | 428/102 |
| 3,088,517 | A * | 5/1963 | Schwartz | A47C 7/22 | 297/452.63 X |
| 3,175,269 | A * | 3/1965 | Raduns | A47C 7/22 | 297/452.63 X |

(Continued)

FOREIGN PATENT DOCUMENTS

| | | | | |
|---|---|---|---|---|
| DE | 10337267 B3 * | 2/2005 | A47C 31/023 |
| FR | 688743 A * | 8/1930 | A47C 7/282 |

(Continued)

*Primary Examiner* — Rodney B White

(74) *Attorney, Agent, or Firm* — Quarles & Brady LLP

(57) ABSTRACT

A system for hiding flash in a suspension seat includes a frame having a channel having at least one wall, a fabric seat surface and a carrier over-molded onto the seat surface. The carrier has a wall and is over-molded onto the seat surface such that the seat surface extends from the wall. The carrier and a portion of the seat surface at a juncture of the carrier and the seat surface are positioned in the channel with the portion of the seat surface abutting the wall of the channel, such that flash formed at the juncture of the carrier and the seat surface is positioned against the wall of the channel. A seat formed thereby and a method for making the seat are disclosed.

20 Claims, 7 Drawing Sheets

(56) References Cited

U.S. PATENT DOCUMENTS 3,179,469 A * 4/1965 Heuston ..... A47C 7/282 297/452.56
3,498,668 A * 3/1970 Vanderminden ..... A47C 4/30 297/45
3,844,612 A * 10/1974 Borggren ..... A47C 5/06 297/451.3
5,121,963 A * 6/1992 Kwasnik ..... B60N 2/793 297/218.5 X
6,378,944 B1 * 4/2002 Weisser ..... A47C 7/282 297/218.5 X
6,478,382 B1 * 11/2002 Schulte ..... B60N 2/58 297/218.1 X
6,511,562 B1 * 1/2003 Coffield ..... B29C 66/12421 297/218.3 X
6,767,066 B1 * 7/2004 Tornero ..... A47C 7/282 297/354.1
6,942,300 B2 * 9/2005 Numa ..... A47C 7/282 297/218.3
6,966,606 B2 * 11/2005 Coffield ..... A47C 7/282 297/452.56 X
6,983,997 B2 * 1/2006 Wilkerson ..... A47C 1/023 297/452.13
7,040,834 B2 * 5/2006 Nardi ..... A47C 31/023 297/452.13 X
7,270,378 B2 * 9/2007 Wilkerson ..... A47C 1/023 297/452.13
7,600,304 B2 * 10/2009 Nagele ..... B60N 2/5825 156/66
8,109,576 B2 * 2/2012 Lin ..... A47C 7/40 297/452.56
9,126,519 B2 * 9/2015 Uebelacker ..... B60N 2/68
2007/0170756 A1 * 7/2007 Kang ..... A47C 31/023 297/218.5
2008/0157575 A1 * 7/2008 Janz ..... B60N 2/5664 297/218.1 X

FOREIGN PATENT DOCUMENTS

GB 656964 A * 9/1951 ..... A47C 31/02
WO WO-2005025379 A1 * 3/2005 ..... A47C 7/282

* cited by examiner

SYSTEM AND METHOD FOR HIDING MOLDING FLASH

CROSS-REFERENCE TO RELATED APPLICATION DATA

This application claims the benefit of and priority to Provisional U.S. Patent Application Ser. No. 62/831,527, filed Apr. 9, 2019, titled SYSTEM AND METHOD FOR HIDING MOLDING FLASH, the disclosure of which is incorporated herein in its entirety.

BACKGROUND

The present disclosure relates to a system and method for hiding molding flash and more particularly, to a system and method for hiding molding flash in a suspension member, such as a suspension fabric for seating.

Suspension or suspended fabrics have come into common use as an alternative to hard surfaces and foam padded surfaces for seating. Such suspension fabric seating surfaces can provide the comfort of foam padded surfaces in a weight similar to hard plastic seating and at relatively low cost. Advantageously, suspension fabric seating provides enhanced comfort using a preset tension in the suspension fabric that is adjustable for reaction force for comfort needs.

In the manufacture of fabric suspension seating, the fabric seating surface is over-molded with a polymer to form a carrier. The carrier and fabric are then joined to a seat frame. In over-molding the carrier, the fabric is positioned and clamped between two halves of an injection mold. The injection mold halves, when clamped together, define a cavity in which the carrier is molded. A polymer is injected into the cavity, over the fabric, to form the carrier over-molded onto the fabric.

The injection molding process is carried out under relatively high pressure. As such, tooling conditions near the parting line P (see for example, FIG. 2), which is the line along which the mold halves meet, are designed to ensure maximum clamping forces are concentrated near the parting line. This is to maximize the amount of pressure near the cavity edge to minimize or prevent plastic from pushing past the parting line P. Flash results when plastic leaks past the parting line P. When conventional design rules are followed, that is when the mold halves are tightly clamped to each other with nothing interfering with the cavity edges, the injection molding process exhibits flash-free products for thousands of cycles.

When, however, an object is inserted between the mold halves, flash may result due to gaps at the mating surfaces or along the parting line P. For example, when a carrier is over-molded onto a fabric seating surface, problems can arise because the fabric is positioned between, and prevents complete closure of, the mold halves. Due to the porous nature of the fabric and open spaces (open weave) between weft fibers W and the warp fibers R in the fabric (see for example, FIGS. 1A and 1B), the mold halves will not close completely and seal to form a best practice parting line P condition. As such, two problems arise when over-molding onto the fabric: 1) the thickness of the fabric prevents the two halves of the mold from touching each other, which hinders the parting line P seal or shut off; and 2) the fabric itself is not homogeneous, so openings in the weave of the fabric allow plastic to flow through the openings in the fabric. FIGS. 2 and 3 illustrate a woven fabric with a thermoplastic ring molded over the fabric and flash that results from plastic breaching the parting line P. Areas between the fill R rows or between the monofilament W rows can contain variable levels of flash or finger flash. FIG. 3 shows the finger like flash F.

Plastic that flows beyond the parting line P on the fabric surface between the fill or warp rows forms the flash. The flash peninsulas are called finger flash, because the "rows" of flash often separate from each other like fingers on a hand. When finger flash occurs, it eventually breaks free from the fabric after several cycles. When it breaks free, the finger flash tends to stand up away from the fabric surface at an angle (see FIGS. 5A and 5B). When the seating surface (the fabric surface and carrier) is installed in the seat frame, finger flash projections that are subjected to fabric tension that can stand up and snag an occupant's skin or clothing.

Accordingly, there is a need for a system, including a seat, and a method for a suspension fabric seating carrier and surface that prevents flash from projecting from the surface. Desirably, in such a fabric seating carrier and surface, the flash is hidden away from occupant view and is not accessible to occupants and occupants' clothing so that it doesn't catch on the occupant or the occupant's clothing.

SUMMARY

In one aspect, a system for hiding flash in a suspension seat includes a frame having a channel having at least one wall, a fabric seating surface and a carrier over-molded onto the seating surface. The carrier has a wall and is over-molded onto the seating surface such that the seating surface extends out of the carrier from the wall. In embodiments, the fabric seating surface is a woven fabric material.

The carrier and a portion of the seating surface at a juncture of the carrier and the seating surface are positioned in the channel with the portion of the seating surface abutting the wall of the channel, such that flash formed at the juncture of the carrier and the seating surface is positioned against the wall of the channel. The carrier can be formed having a parting line and the seating surface can extend from the carrier at the parting line. In such an embodiment, the parting line faces the channel wall.

In an embodiment, the carrier has an upper wall and a lower wall, and the wall from which the seating surface extends is a sidewall. The channel wall can be a sidewall so that the flash is captured between carrier sidewall and the channel sidewall. In a preferred embodiment, the flash is unexposed at the carrier upper wall.

In another aspect, a suspension seat includes a seating surface, and a carrier over-molded onto the seating surface such that the seating surface extends from the wall. The seat includes a frame having a wall and the carrier and a portion of the seating surface at a juncture of the carrier and the seating surface are positioned in the frame with the portion of the seating surface abutting the frame wall. Flash formed at the juncture of the carrier and the seating surface is isolated between the carrier wall and the frame wall.

In an embodiment, the carrier wall is an inner wall and the carrier further includes upper and lower walls and an outer wall. The frame can include a channel formed therein, and the frame wall forms an inner wall of the channel. The channel further includes an outer wall and a lower wall. When positioned in the channel, the portion of the seating surface is captured between the carrier inner wall and the frame wall and flash is unexposed beyond the carrier inner wall and the frame wall.

In still another aspect, a method for hiding flash in a suspension seat includes over-molding a carrier onto a fabric seat surface. The carrier is formed having a wall and is over-molded onto the seating surface such that the seating surface extends from the carrier wall.

The method includes positioning the over-molded carrier and seating surface in a seat frame, against a wall of seat the frame. The carrier and a portion of the seating surface at a juncture of the carrier and the seating surface are positioned in the seat frame with the portion of the seating surface abutting the seat frame wall. Any flash that is formed at the juncture of the carrier and the seating surface is positioned against the seat frame wall, unexposed to an occupant of the seat.

The method can include forming the seat frame with a channel so that the seating surface and carrier can be positioned in the channel with a portion of the seating surface, adjacent the juncture of the carrier and the seating surface, extending along the carrier, between the carrier wall and the channel to capture flash between the carrier wall and the frame wall. The method can also include securing the carrier in the frame by, for example, fasteners.

BRIEF DESCRIPTION OF THE DRAWINGS

The benefits and advantages of the present embodiments will become more readily apparent to those of ordinary skill in the relevant art after reviewing the following detailed description and accompanying drawings, wherein.

DETAILED DESCRIPTION

Figure 1A:
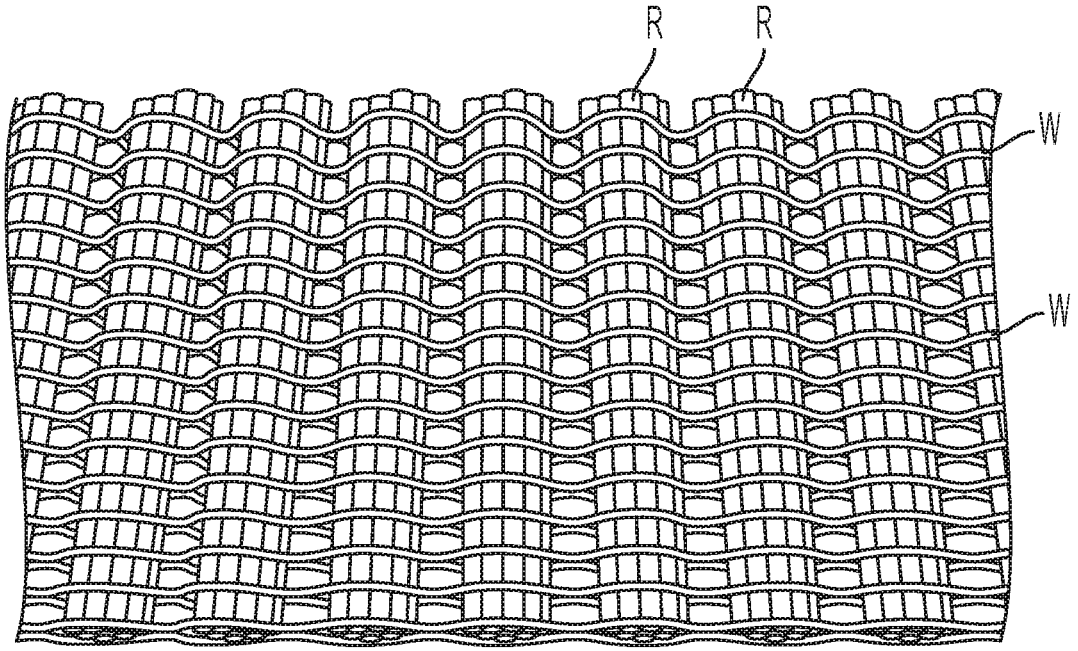
FIGS. 1A and 1B are illustrations of fabrics, illustrating a known suspension seat bottom formed from warp and weft fibers.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 5A:
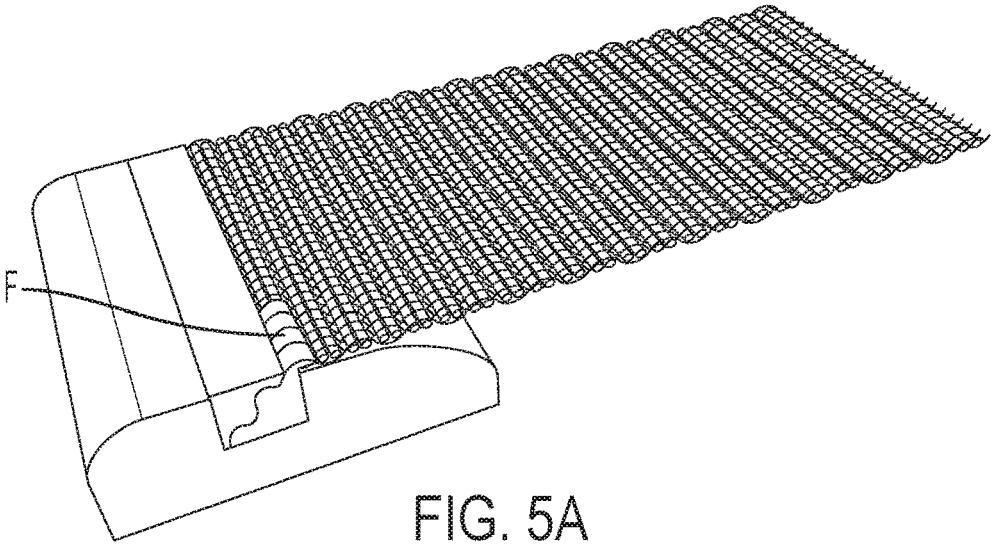
FIGS. 5A and 5B show the finger flash after molding (FIG. 5A) and the finger flashing standing up after a number of cycles of fabric tension (FIG. 5B)
Figure 5B:
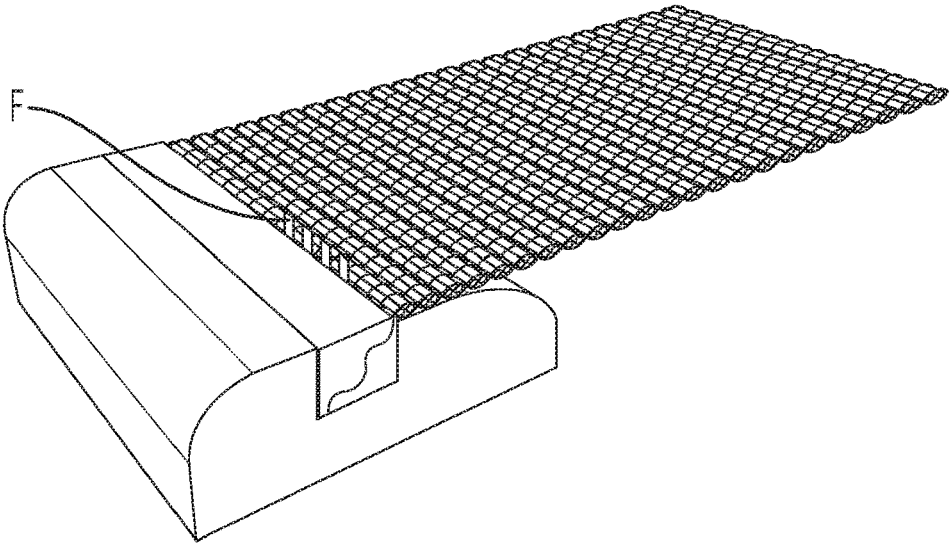

Flash F that projects from a seating surface, for example as illustrated in FIGS. 5A and 5B, can be problematic when it projects along or out of the seat surface. It can adversely affect the aesthetics of the seat, and can catch on occupant's skin or clothing.

In an embodiment of a system, seat, and method to reduce flash in accordance with the present disclosure, referring to FIGS. 8A-B and 9A-B, a carrier 10 is over-molded onto a seating surface 12 such that the seating surface 12 exits the carrier 10 at a location 14 along a wall of the carrier 10. In an embodiment, the seating surface 12 extends from, or exits the carrier 10 along a sidewall 16 of the carrier 10 between upper and lower surfaces or walls 18, 20 of the carrier 10 (the upper wall 18 of the carrier 10 being flush with a surface 22 of the seat frame 24). That is, the fabric that forms the seating surface 12 is molded into the carrier 10 between the upper and lower walls 18, 20 of the carrier 10 and exits the carrier 10 at a carrier/surface juncture, indicated generally at 32, that is along a sidewall 16 of the carrier 10. The carrier/surface juncture 32 is at the parting line P of the mold halves.

Figure 1B:
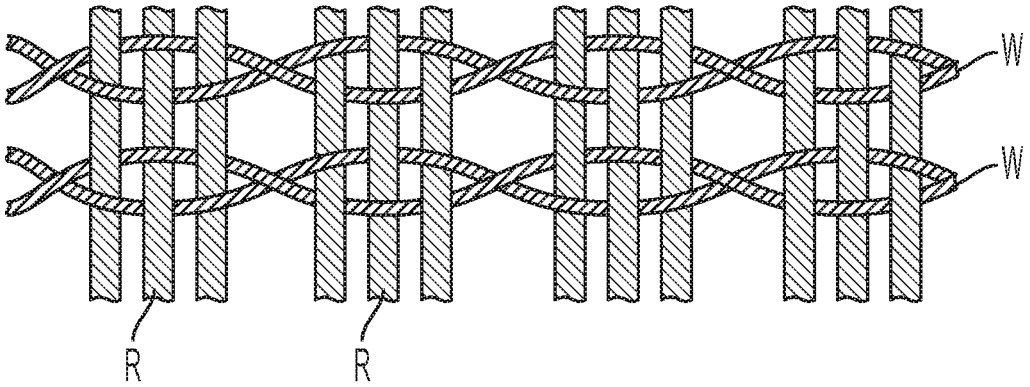
Figure 2:
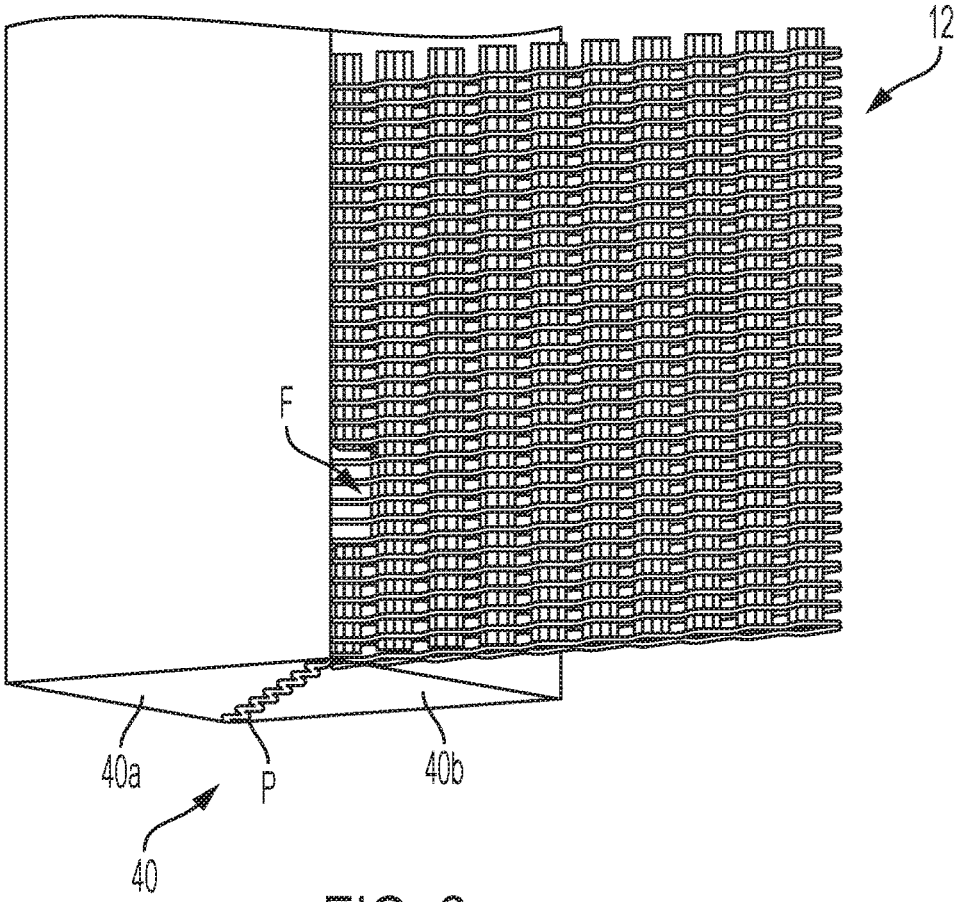
FIGS. 2 and 3 illustrate a carrier over-molded onto a fabric seating surface, and show flash that forms around the fabric beyond the mold.
Figure 3:
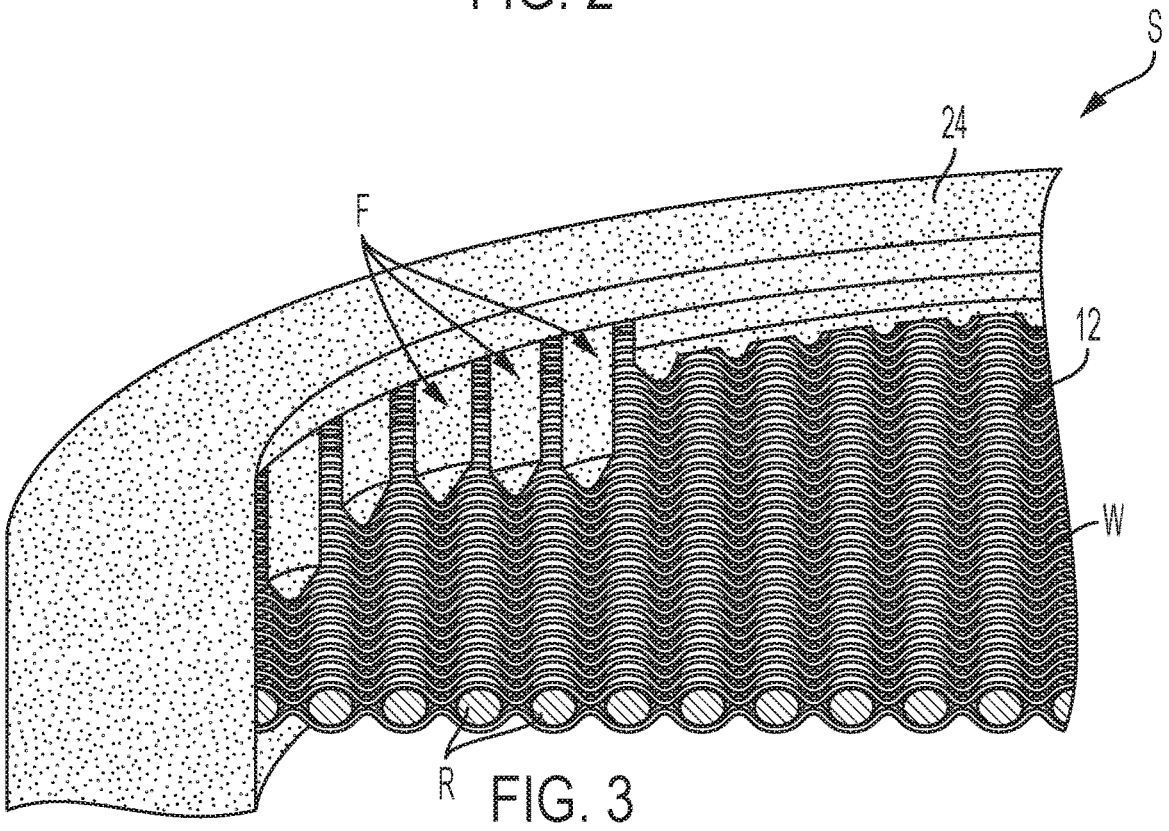
Figure 4:
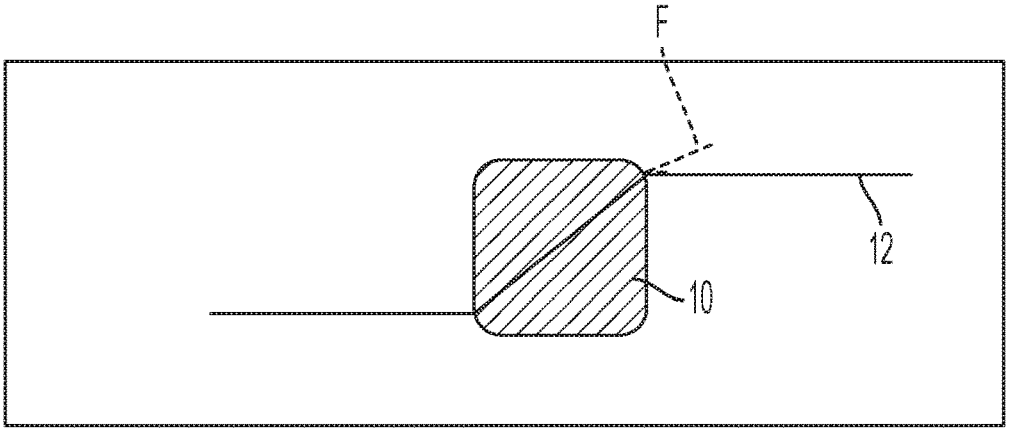
FIG. 4 is a sectional view showing flash that projects from the carrier at the carrier/seating surface juncture.

As noted above, and as seen in FIGS. 1A and 1B, the seating surface 12 may not be a solid surface. That is, the seating surface 12 can be formed from a woven fabric material that has openings in the fabric. In one seating surface 12, the surface is a weave of weft fiber W and warp fibers R. The weft fibers W can be, for example, monofilament fibers such as a block copolymer monofilament, and the warp fibers R can be fill fibers, such as a polyester yarn. And, in instances, the fibers forming the fabric may be porous. As such, with the fabric positioned and clamped between two halves 40*a,b* of an injection mold 40, gaps will form at the juncture of the mold halves or at the parting line P. As the carrier 10 material is injected into the mold 40 at relatively high pressure, the liquified material will leak through the parting line P, at least at the locations where the fabric is present along the parting line P, and/or may leak through the woven fabric, forming flash F.

After the carrier 10 is over-molded onto the seating surface 12, the carrier 10 is positioned in the seat frame 24. In order to prevent exposure of the flash F, in positioning the carrier 10 in the frame 24, the wall 16 of the carrier 10 from which the seating surface 12 exits is positioned along a wall 26 of the frame channel 28. That is, the carrier wall 16 from which the seating surface 12 exits the carrier 10 is hidden within the seat frame channel 28. In this manner, the portion (indicated at 30) of the seating surface 12 immediately adjacent to the carrier 10 is tucked between carrier wall 16 (above the carrier/surface juncture 32) and the frame channel sidewall 26. With the portion 30 of the seating surface 12 adjacent to the carrier 10 tucked between the carrier 10 and the channel wall 26, the flash F formed when the carrier 10 is over-molded onto the seating surface 12 is also tucked between the carrier 10 and the channel wall 26. This "hides" the flash F, tucking it into an unseen area of the seat S, which prevents the flash F from extending from the seating surface 12 which could otherwise detract from the aesthetics of the seat, and can catch on an occupant's clothing or skin.

In the illustrated embodiment, the seating surface 12 exits the carrier 10 along a sidewall 16 of the carrier 10 that is adjacent to a sidewall 26 of the frame channel 28, such that the carrier sidewall 16 and flash F is hidden within the channel 28. It is also contemplated that the wall from which the seating surface 12 (and flash F) extend from the carrier 10 can be a bottom or lower wall, the effect being that the exit wall is hidden so that flash F is maintained within the channel 28, is hidden from view and does not contact the seat occupant.

A method for hiding flash F in a suspension seat S includes over-molding a carrier 10 onto a fabric seating surface 12. The carrier 10 has a wall and is over-molded onto the seating surface 12 such that the seating surface 12 extends from the wall. In a method, the carrier wall from which the seating surface 12 exits is a sidewall 16.

The method includes positioning the over-molded carrier 10 and the seating surface 12 in a channel 28 in a seat frame 24. The channel 28 has at least one wall and the carrier 10 and a portion 30 of the seating surface 12 at a juncture 32 of the carrier 10 and the seating surface 12 are positioned in the channel 28 with the portion 30 of the seating surface 12 abutting the wall of the channel 28. In this manner, any flash F formed at the juncture 32 of the carrier 10 and the seating surface 12 is positioned against the wall of the channel 28.

In a method, the wall is a sidewall 26 of the channel 28. The channel 28 can be formed by at least two walls and preferably three walls to capture the carrier 10 in the channel 28. The method can further include securing the carrier 10 in the channel 28. The carrier 10 can be secured in the channel 28 in a variety of ways, such as by fasteners 44, adhesives, welding and the like.

Figure 6:
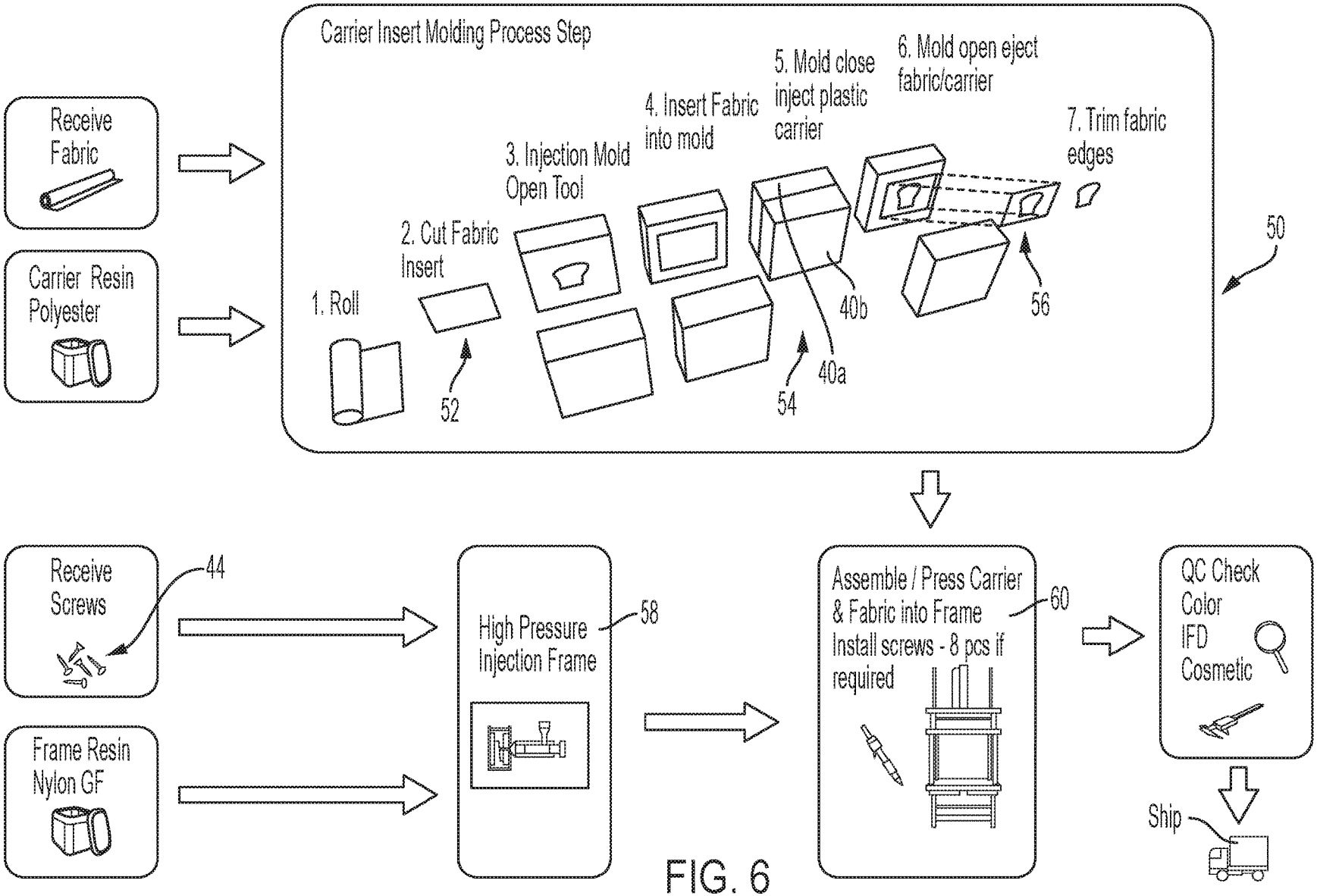
FIG. 6 is a flow diagram/illustration of one overall seat fabrication process.
Figure 7:
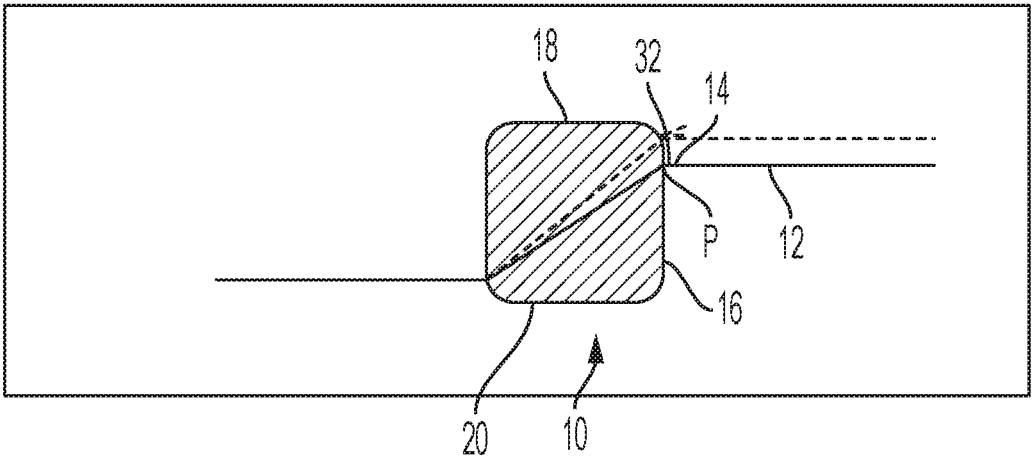
FIG. 7 is an illustration of an embodiment of an over-molded seating surface and carrier in accordance with the present disclosure.
Figure 8A:
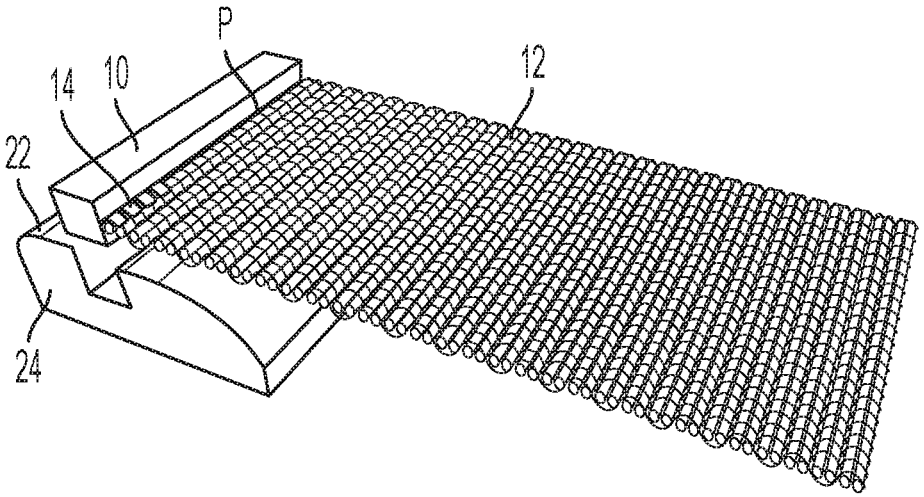
FIGS. 8A and 8B are perspective and side views of the over-molded seating surface and carrier positioned above and prior to insertion into a seat frame.
Figure 8B:
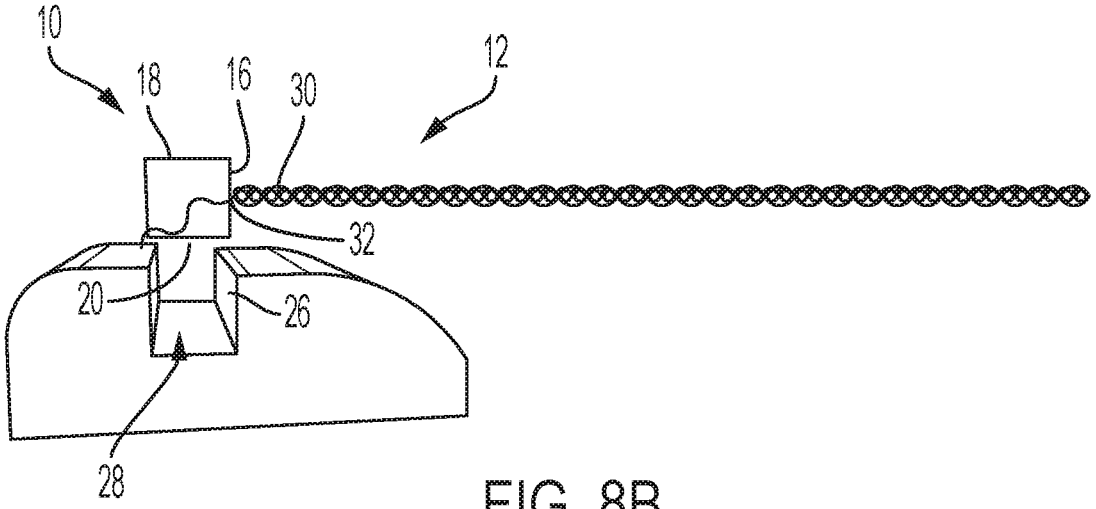
Figure 9A:
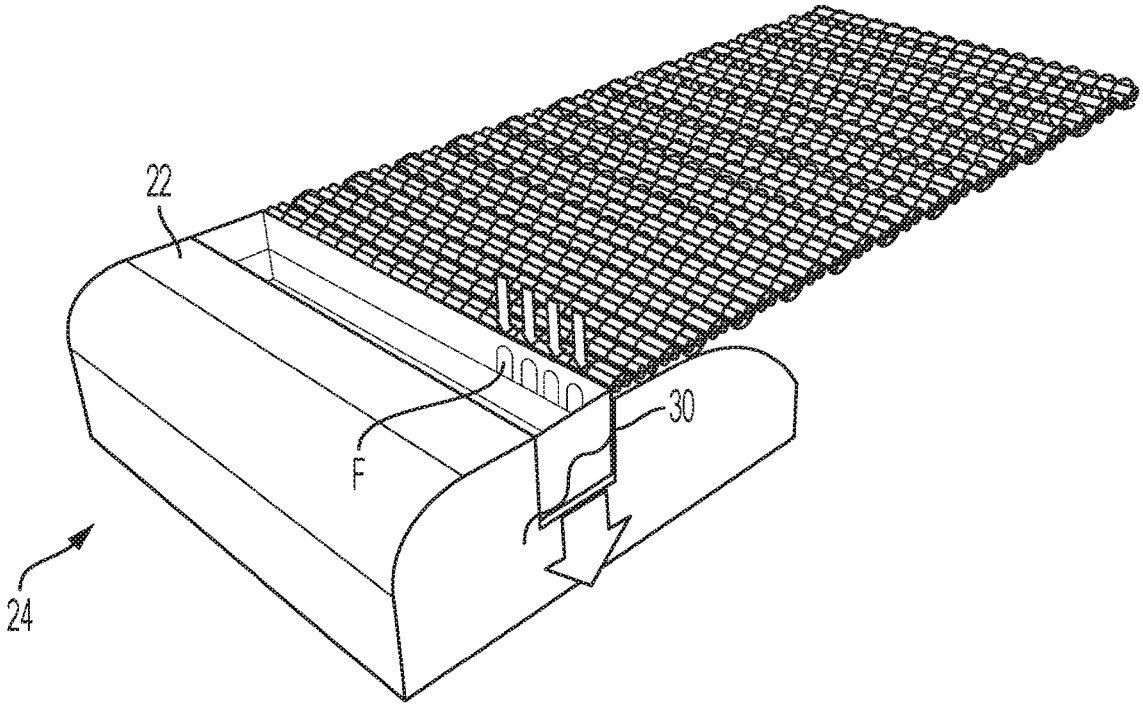
FIGS. 9A and 9B illustrate the over-molded seating surface and carrier being inserted into (FIG. 9A) and seated in the seat frame (FIG. 9B).
Figure 9B:
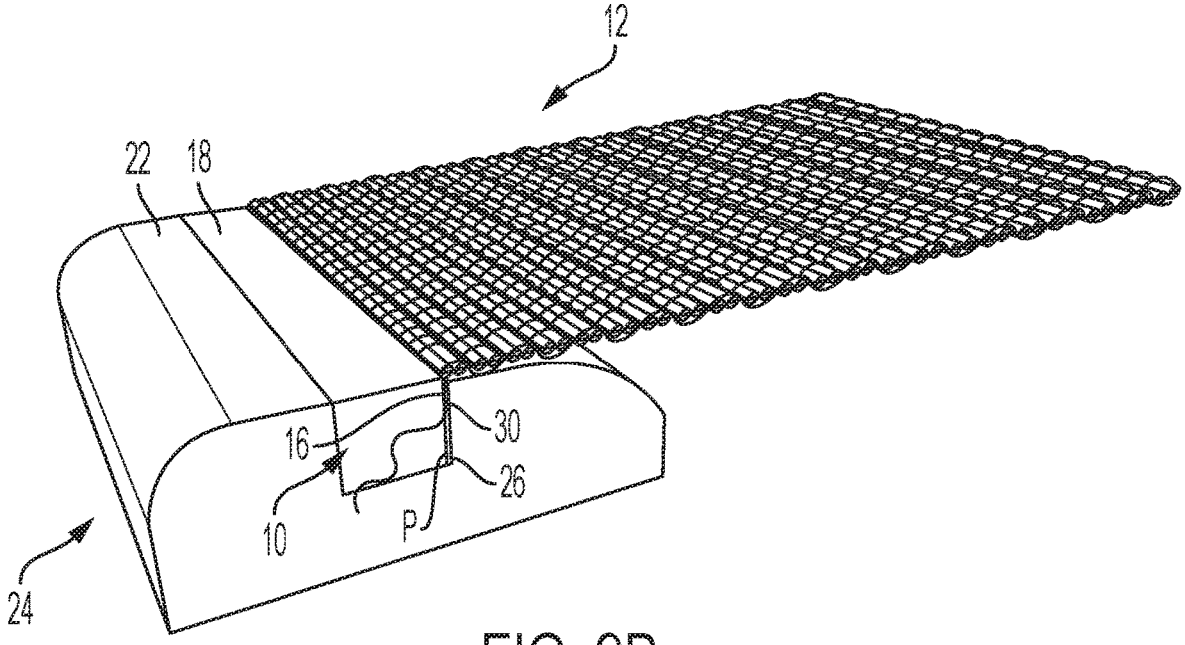

FIG. 6A illustrates at 50, generally, a process for the manufacture and assembly of a seat S, having a seating surface 12, in a frame 24. At step 52, the seating surface 12 material can first be cut to an approximate size and positioned in the open injection mold tool 40. The tool 40 is closed on the material and the carrier 10 material is molded onto the seating surface 12 material at step 54. At this point, flash F may, and is expected to be present where the seating surface 12 material is captured between the closed mold tool halves 40*a,b* (at the parting line P). If needed, excess seating surface 12 material can be trimmed from around the outside of the carrier 10 at step 56.

At step 58 the seat frame 24 is formed, as by injection molding, and at step 60 the seating surface 12 with the over-molded carrier 10 is assembled into the frame 24, as by pressing the carrier 10 into the frame 24. The carrier 10 and seating surface 12 can then be secured in the frame 24, using, for example, fasteners 44.

It will be appreciated that relocating the mold parting line P of the carrier 10 (which is the line formed where the mold halves 40*a,b* meet and where the seating surface 12 exits carrier 10, at the carrier/seat surface juncture 32) to a location within the frame channel 28, hides the parting line P, and avoids impacting the aesthetic and comfort-related surfaces of the seat. That is, the parting line P is hidden from occupant view and contact.

Moreover, by relocating the parting line P, the injection molding process can be opened to a wider range of operating parameters, such as increased injection pressures, increased parting line tonnage, differing resin viscosities and pack pressure. Some of the increased operating parameter ranges can further help to reduce scrap that results from the injection molding process. Furthermore, because fabric dimensional variation and porosity can also influence the production of flash F, the present system and method for hiding molding flash F permits using a wider variety and different types of suspension fabrics.

It will also be appreciated that the present system and method to hide molding flash F provide design and material freedom not achievable in prior known seat S designs. Such a system, seat and method minimize or eliminate visible flash F and parting lines P that otherwise detract from the aesthetics and comfort of such seats S.

In the present disclosure, the words "a" or "an" are to be taken to include both the singular and the plural. Conversely, any reference to plural items shall, where appropriate, include the singular. It will be appreciated by those skilled in the art that the relative directional terms such as upper, lower, rearward, forward and the like are for explanatory purposes only and are not intended to limit the scope of the disclosure.

All patents or patent applications referred to herein, are hereby incorporated herein by reference, whether or not specifically done so within the text of this disclosure.

From the foregoing it will be observed that numerous modification and variations can be effectuated without departing from the true spirit and scope of the novel concepts of the present film. It is to be understood that no limitation with respect to the specific embodiments illustrated is intended or should be inferred. The disclosure is intended to cover by the appended claims all such modifications as fall within the scope of the claims.

The invention claimed is:

1. A system for hiding flash in a suspension seat, comprising:

a frame having a channel having at least one wall;

a fabric seat surface; and a carrier over-molded onto the seat surface, the carrier having a wall, the carrier over-molded onto the seat surface such that the seat surface extends from the carrier wall, wherein the carrier and a portion of the seat surface at a juncture of the carrier and the seat surface are positioned in the channel with the portion of the seat surface abutting the wall of the channel, such that flash formed at the juncture of the carrier and the seat surface is positioned against the wall of the channel, and wherein the seat surface extends through the carrier at a generally downward angle with respect to the carrier wall.

2. The system of claim 1, wherein the carrier has an upper wall and a lower wall, and wherein the wall from which the seat surface extends is a sidewall.

3. The system of claim 2, wherein the channel wall is a sidewall.

4. The system of claim 1, wherein the channel wall is a sidewall.

5. The system of claim 1, wherein the fabric seat surface is a woven fabric material.

6. The system of claim 1, wherein when the seat surface and carrier are positioned in the frame, a portion of the seat surface, adjacent the juncture of the carrier and the seat surface, extends along the carrier, between the carrier and the channel wall.

7. The system of claim 6, wherein the flash is unexposed at the carrier upper wall.

8. The system of claim 1, wherein the seat surface extends from the carrier at a parting line in the carrier and wherein the parting line faces the channel wall.

9. A seat suspension, comprising:

a seat surface;

a carrier over-molded onto the seat surface, the carrier having a wall, the carrier over-molded onto the seat surface such that the seat surface extends from the carrier wall, a frame having a wall, wherein the carrier and a portion of the seat surface at a juncture of the carrier and the seat surface are positioned in the frame with the portion of the seat surface abutting the frame wall, such that flash formed at the juncture of the carrier and the seat surface is isolated between the carrier wall and the frame wall, and wherein the carrier wall is an inner wall and the seat surface extends from the carrier at a parting line, the parting line extending from above a midpoint on the inner wall of the carrier to below a midpoint on an outer wall of the carrier.

10. The seat of claim 9, wherein the inner carrier wall is a sidewall and wherein the frame wall is a sidewall.

11. The seat of claim 9, wherein the carrier further includes upper and lower walls, wherein the frame includes a channel formed therein, the frame wall forming an inner wall of the channel, the frame further including an outer wall and a lower wall, and wherein the portion of the seat surface is captured between the carrier inner wall and the inner wall of the channel.

12. The seat of claim 9, wherein the flash is unexposed beyond the carrier inner wall and the frame wall.

13. The seat of claim 9, wherein the parting line faces the channel wall.

14. A method for hiding flash in a suspension seat, comprising:

over-molding a carrier onto a fabric seat surface, the carrier having a wall, the carrier over-molded onto the seat surface such that the seat surface extends through the carrier and exits the carrier from the carrier wall; and positioning the over-molded carrier and the seat surface in a seat frame, the seat frame having a wall, wherein the carrier and a portion of the seat surface at a juncture of the carrier and the seat surface are positioned in the seat frame with the portion of the seat surface abutting the seat frame wall, such that any flash formed at the juncture of the carrier and the seat surface is positioned against the seat frame wall, unexposed to an occupant of the seat.

15. The method of claim 14 wherein the carrier wall from which the seat surface extends is a sidewall.

16. The method of claim 15 wherein the seat frame has a channel, the seat frame wall forming a portion of the channel.

17. The method of claim 16 wherein when the seat surface and carrier are positioned in the channel, a portion of the seat surface, adjacent the juncture of the carrier and the seat surface, extends along the carrier, between the carrier wall and the channel to capture flash between the carrier wall and the frame wall.

18. The method of claim 14, further including securing the carrier in the frame.

19. The method of claim 18, wherein the carrier is secured in the frame by fasteners.

20. The method of claim 14, wherein the carrier is molded having a parting line, and wherein the seat surface extends from the parting line.

* * * * *